US011581121B1

(12) United States Patent
Martinez et al.

(10) Patent No.: US 11,581,121 B1
(45) Date of Patent: Feb. 14, 2023

(54) COMMON MODE CHOKE

(71) Applicant: Embedded Systems Inc., Simi Valley, CA (US)

(72) Inventors: Armando Martinez, Sherman Oaks, CA (US); Kerwyn Dale Schimke, Simi Valley, CA (US)

(73) Assignee: EMBEDDED SYSTEMS INC., Simi Valley, CA (US)

( * ) Notice: Subject to any disclaimer, the term of this patent is extended or adjusted under 35 U.S.C. 154(b) by 887 days.

(21) Appl. No.: 15/853,011

(22) Filed: Dec. 22, 2017

Related U.S. Application Data

(60) Provisional application No. 62/560,648, filed on Sep. 19, 2017.

(51) Int. Cl.
*H01F 27/28* (2006.01)
*H01F 27/24* (2006.01)

(52) U.S. Cl.
CPC ..... *H01F 27/28* (2013.01); *H01F 27/24* (2013.01); *H01F 27/2876* (2013.01)

(58) Field of Classification Search
CPC ..... H01F 27/28; H01F 27/24; H01F 27/2876
USPC ..... 336/200, 232, 229
See application file for complete search history.

(56) References Cited

U.S. PATENT DOCUMENTS 4,536,733 A * 8/1985 Shelly ..... H01F 27/06 336/182
5,781,091 A * 7/1998 Krone ..... H01F 17/0033 336/200
8,063,728 B2 * 11/2011 Brunel ..... H01F 27/303 336/92
2007/0008058 A1 * 1/2007 Hashimoto ..... H01F 17/0033 336/200
2009/0002111 A1 * 1/2009 Harrison ..... H01F 19/04 336/69
2017/0236635 A1 * 8/2017 Otsubo ..... H01F 17/06 336/200
2018/0019049 A1 * 1/2018 Lazarus ..... H01F 27/022

FOREIGN PATENT DOCUMENTS

DE 4221769-01 * 1/1994 ..... H01F 17/06
JP 06302437 A * 10/1994 ..... H01F 17/045
WO WO-2017141838 A1 * 8/2017 ..... H01F 17/045

OTHER PUBLICATIONS

Choke (electronics). (Aug. 18, 2017). In Wikipedia, The Free Encyclopedia. Retrieved 17:43, Nov. 27, 2017, from https://en.wikipedia.org/w/index.php?title=Choke_(electronics)&oldid=796043531.

Pulse Company "Understanding Common Mode Noise." Apr. 1999 https://www.pulseelectronics.com/wp-content/uploads/2016/12/G019.pdf accessed Nov. 27, 2017.

* cited by examiner

*Primary Examiner* — Tszfung J Chan
(74) *Attorney, Agent, or Firm* — Concept IP LLP; Pejman Yedidsion

(57) ABSTRACT

A common mode choke apparatus includes a first bus bar forming a first plurality of loops about a first segment of a ferrite core, the first bus bar having a plurality of first upper surfaces, and a second bus bar forming a second plurality of loops about a second segment of the ferrite core, the second bus bar having a plurality of second upper surfaces.

14 Claims, 4 Drawing Sheets

COMMON MODE CHOKE

BACKGROUND

Field of the Invention

The invention relates to common mode chokes, and more particularly to high power systems having common mode coils.

Description of the Related Art

Common mode chokes may be used to reduce high frequency voltage noise, such as electro-magnetic interference (EMI), in low frequency or direct current (DC) systems. A typical common-mode choke configuration 100 includes two insulated coils (102, 104) wound around a single core 260, such as a ferromagnetic core (see FIG. 1), that serves to attenuate a portion of the EMI noise. Magnetic fields produced by in-phase current passing in opposite directions (differential mode current) tend to be equal but opposite to cancel each other out. Any noise common to both coils of the common mode choke tend to cancel each other out when each wire passes the current in opposite directions.

The maximum current rating of the common mode choke is typically determined by the heating effect of the winding resistance. As greater current is provided through the wires, greater heat is generated which must be removed from the system. Unfortunately, this may be a severe problem in high power systems that require physically small common mode chokes. Heat carrying capacity may be increased with increased wire diameters, but removal of excess heat becomes problematic as the thermal transfer of excess heat is impeded by the small contact surface area between a particular wire and either the ferromagnetic core or external heat sink due to the geometries presented (i.e., round wire and relatively flat heat sink or ferromagnetic core).

A need exists to increase the current capacity of common mode chokes while providing sufficient removal of excess heat for smaller system packages.

SUMMARY

A common mode choke apparatus includes a first bus bar forming a first plurality of loops about a first segment of a ferrite core, the first bus bar having a plurality of first upper surfaces, and a second bus bar forming a second plurality of loops about a second segment of the ferrite core, the second bus bar having a plurality of second upper surfaces. Each of first and second upper surfaces may be planar. In one embodiment, each of the first and second upper surfaces extend in a plane. In other embodiments, each of the first and second upper surfaces are non-planar. The apparatus may also include a heat sink thermally coupled to the plurality of planar first and second surfaces. Each of the plurality of planar first upper surfaces may have a serpentine shape from an inner region to an outer region of the common mode choke. In such embodiments, each of the inner first upper surface portions may be circumferentially offset from its respective outer first upper surface portions. In certain embodiments, each of the plurality of planar first upper surfaces may have an annulus-segment shape from an inner first upper surface portion to an outer first upper surface portion rather than the serpentine shape. The ferrite core may be formed in the shape of a rectangular toroid.

Another common mode choke apparatus may include a first bus bar extending circumferentially about a first segment of a toroidal ferrite core, the first bus bar having a first plurality of planar first upper surfaces, a second bus bar extending circumferentially about a second segment of a ferrite core, the second bus bar having a second plurality of planar second upper surfaces, and a heat sink thermally coupled to the first and second plurality of upper surfaces so that excess heat emitted from the first and second bus bars is transmitted to the heat sink. The first bus bar may also include a third plurality of planar first bottom surfaces. The apparatus may also include a second heat sink thermally coupled to the third plurality of planar first bottom surfaces.

Another common mode choke apparatus may include a first conductive rigid winding about a ferrite core to form a first signal path, and a second conductive rigid winding about the ferrite core to form a second signal path so that the first and second conductive rigid windings establish a planar upper surface. The first conductive rigid winding may extend in a planar and serpentine manner about an upper surface of the common mode choke. The conductive rigid winding may extend in a planar and serpentine manner about a bottom surface of the common mode choke, and the ferrite core may be seated in a bottom ferrite channel. In one embodiment, the first conductive rigid winding comprises a plurality of rigid plates. Each of the rigid plates may extend in a serpentine manner from an inner radius of the common mode choke apparatus to an outer radius of the common mode choke apparatus. An inner radius of each rigid plate may be rotationally offset from an outer radius of each rigid plate. The apparatus may also include a heat sink in thermal communication with the upper surface.

BRIEF DESCRIPTION OF THE DRAWINGS

The components in the figures are not necessarily to scale, emphasis instead being placed upon illustrating the principals of the invention. Like reference numerals designate corresponding parts throughout the different views.

DETAILED DESCRIPTION

A common mode choke is described that uses two bus bars wrapped about two halves of a toroidal ferrite core, respectively, to increase the current capacity of a common mode choke while providing sufficient removal of excess heat for smaller system packages. The rectangular and relatively large cross section of each bus bar allows for efficient packing of the adjacent four bus bar loops about the ferrite core. Flat upper surfaces of each bus bar loop enable greater thermal interface surface area between the bus bar and a thermally coupled heat sink. Serpentine wrapping of upper and lower bus bar loop portions about the ferrite core enable greater upper/lower inner and upper/lower outer contact surfaces between upper and lower portions of each loop.

Figure 1:
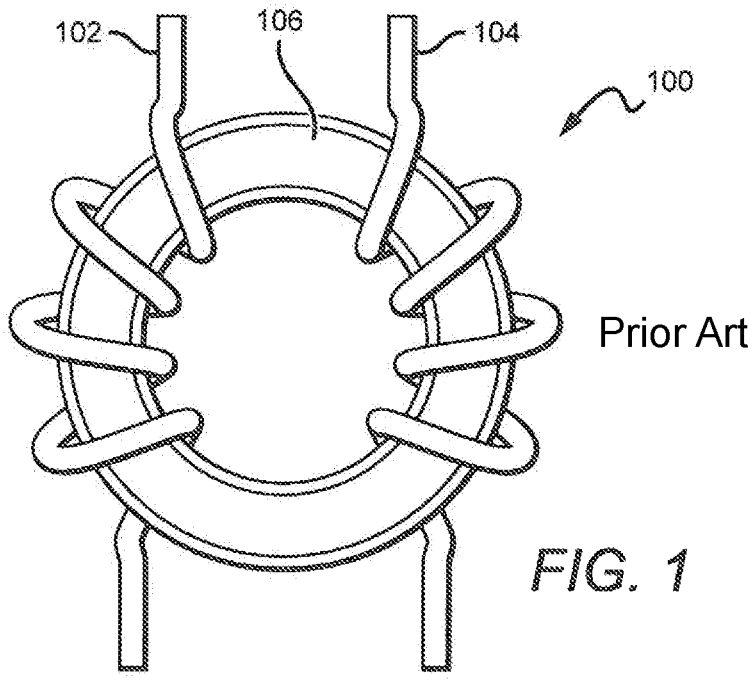
FIG. 1 (Prior Art) is a front plan view of a prior art common mode coil.
Figure 3:
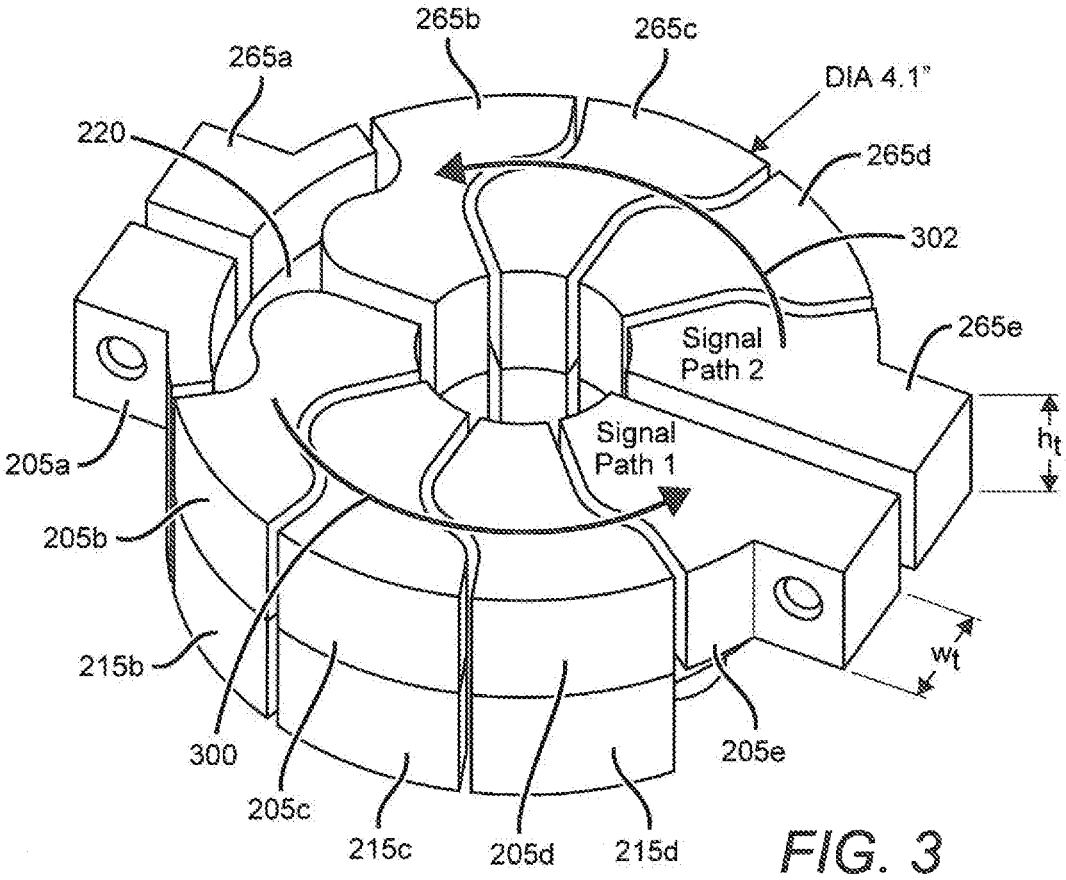
FIG. 3 is an assembled perspective view of the common mode coil illustrated in FIG. 2.
Figure 2:
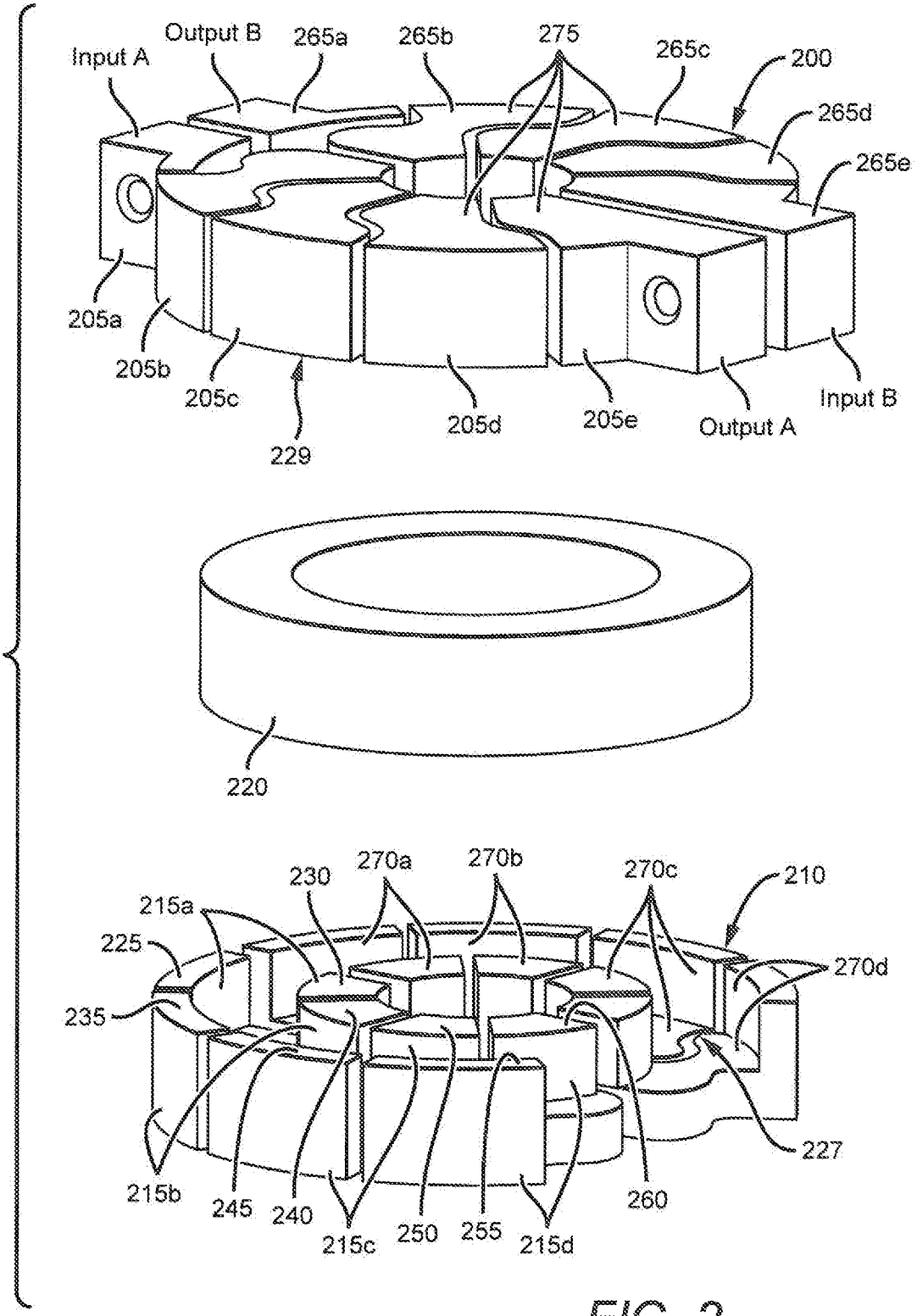
FIG. 2 is an exploded perspective view of one embodiment of a common mode coil having upper and lower coil fingers forming two looped signal paths about a ferrite core.

FIGS. 2 and 3 are an exploded perspective and perspective assembled views, respectively, illustrating upper and lower bus bar coil halves of a common mode choke having a ferrite ring positioned for seating in upper and lower ferrite channels. The upper coil half 200 may have a first plurality of upper coil fingers (205*a*, 205*b*, 205*c*, 205*d*, 205*e*) for use by a top portion of a first looped signal path 300, with adjacent coil fingers spaced apart or otherwise electrically insulated from one another. Coil finger 205*a* may serve as Input Terminal A and upper coil finger 205*e* as Output Terminal A. The lower coil half 210 may have a plurality of lower coil fingers (215*a*, 215*b*, 215*c*, 215*d*) positioned in complimentary opposition to the respective coil fingers of the upper coil half to complete the first looped signal path about the ferrite ring 220 (alternatively referred to as a "ferrite core" or "toroidal ferrite core"). Each of the plurality of upper and lower coil fingers are formed of an electrically and thermally conductive rigid material (such as copper) establishing a rigid winding about the ferrite core, and may be referred to collectively as a first bus bar and individually as rigid plates. The ferrite ring 220 is illustrated as a rectangular toroid.

Turning first to a description of the first looped signal path 300, voltage applied at Input A is conducted down through the upper coil finger 205*a* to an outer contact surface 225 of lower coil finger 215*a*. Lower coil finger 215*a* then conducts the voltage from its outer contact surface 225 down under the lower ferrite channel 227 and up to its inner contact surface 230 for receipt by upper coil finger 205*b*. Upper coil finger 205*b* may then conduct the voltage up and over the upper ferrite channel 229 (not shown) and down to an outer contact surface 235 of lower coil finger 215*b* to establish a first loop about the ferrite ring 220 (when assembled). Lower coil finger 215*b* may then conduct the voltage between its outer contact surface 235 down, under the lower ferrite channel 227 and up to its inner contact surface 240. Upper coil finger 205C may conduct the voltage from inner contact surface 240, up and over upper ferrite channel 229 and down to an outer contact surface 245 of lower coil finger 215*c* to establish a second loop about the ferrite ring 220. Lower coil finger 215*c* may then conduct the voltage down and under the lower ferrite channel 227, and then up to its inner contact surface 250. Upper coil finger 205*d* may then conduct the voltage up and over the lower ferrite channel 229 and down again to outer contact surface 255 of lower coil finger 215*d* to establish a third loop about the ferrite ring 220. The lower coil finger 215*d* may then conduct the voltage down and under the lower ferrite channel 227 for receipt by its inner contact surface 260. From inner contact surface 260 the voltage may be conducted up and over the upper ferrite channel 229 to Output A through upper coil finger 205*e* to establish the fourth loop about the ferrite ring 220. With ferrite ring 220 seated in the lower and upper ferrite channels 227, 229, the signal path between the upper coil fingers and lower coil fingers may be seen to wind about the ferrite ring 220 in a first looped signal path between Input A and Output A. In summary, a signal presented at Input A may be seen to be conducted across a looped signal path defined by the upper coil finger 205*a*, lower coil finger 215*a*, upper coil finger 205*b*, lower coil finger 215*b*, upper coil finger 205*c*, lower coil finger 215*c*, upper coil finger 205*d*, lower coil finger 215*d*, and upper coil finger 205*e* to Output A. Although not illustrated in FIGS. 2 and 3, the upper ferrite channel may have dimensions substantially similar to the lower ferrite channel so that an upper portion of the ferrite core is disposed in the upper ferrite channel and a lower portion of the ferrite core is disposed in the lower ferrite channel.

A description of the second looped signal path 302 may be analogous to the first signal path 300, with a signal applied at Input B conducted across a signal path defined sequentially and in series by an upper coil finger 265*a*, a lower coil finger 270*a*, upper coil finger 265*b*, lower coil finger 270*b*, upper coil finger 265*c*, lower coil finger 270*c*, upper coil finger 265*d*, lower coil finger 270*d*, upper coil finger 265*e* with the upper and lower coil fingers collectively defining a second bus bar.

In the illustrated embodiment, the upper and lower signal paths each have four loops about the ferrite ring 220 and the signal presented to Input A is a 400 A power signal. In other embodiments, fewer or greater numbers of loops may be provided. The ferrite ring may be model number T60006-L2090 core offered by Vacuumschmelze of Hanau, Germany. The terminal heights ($h_t$) may be 0.7 inches, terminal widths ($w_t$) 0.8 inches and outer radius of the upper and lower coil halves (100, 110) each 4.1 inches. Upper and lower coil fingers may be formed of a metal such as copper or of any other electrically and thermally conductive material to enable better electrical and thermal conduction. For example, surfaces of the outer contact surfaces (225, 235, 245, 255, 270) and inner contact surfaces (230, 240, 250, 260) may be coated with gold (Au) and coupled together through a soldering process. Similarly, areas of contact (not shown) between upper coil fingers (265*a*, 265*b*, 265*c*, 265*d*, 265*e*) and lower coil fingers (270*a*, 270*b*, 270*c*, 270*d*) would also be coated for coupling through the same soldering process.

In other embodiments, the upper and lower coil halves (200, 210) do not have a substantially round outer diameter cross section, but rather are square, oblong or of some other shape.

The flat (i.e., "planar") upper surfaces 275 of each upper coil finger in the upper coil half 200 may be thermally coupled to a cold plate or other form of heat sink to provide effective removal of excess heat generated by the looping currents about the ferrite core. In the illustrated embodiment, each of the upper surfaces 275 extend in a plane. In other embodiments, each of the upper surfaces 275 may be planar, but collectively extend to define a curved or otherwise non-planar upper surface. In a further embodiment, each of the upper surfaces 275 are non-planar to facilitate thermal coupling with a non-planar (e.g., concave or convex) surface of a mating heat sink (not shown).

Each of the respective upper and lower coil fingers extends in a serpentine manner from an inner to an outer region of the common mode choke to maximize the contact area available at the inner contact surfaces (225, 235, 245, 255, 270) and outer contact surfaces (230, 240, 250, 260) from what would otherwise exist from an annulus-segment shape or "pie shaped" fingers having planar sides. In addition, each upper coil finger jogs circumferentially (i.e., is circumferentially offset) in a first direction from inner to an outer region of the common mode choke, while each lower coil finger jogs circumferentially (i.e., is circumferentially offset) in a direction opposite from the first direction from the inner to the outer region of the common mode choke to establish a serial electrical connection between upper and lower coil fingers. As used herein, "inner region" refers to a region radially towards the center of the choke, and "outer region" refers to a region radially away from the center of the choke, as the inner and outer regions are referenced by one another.

Figure 4:
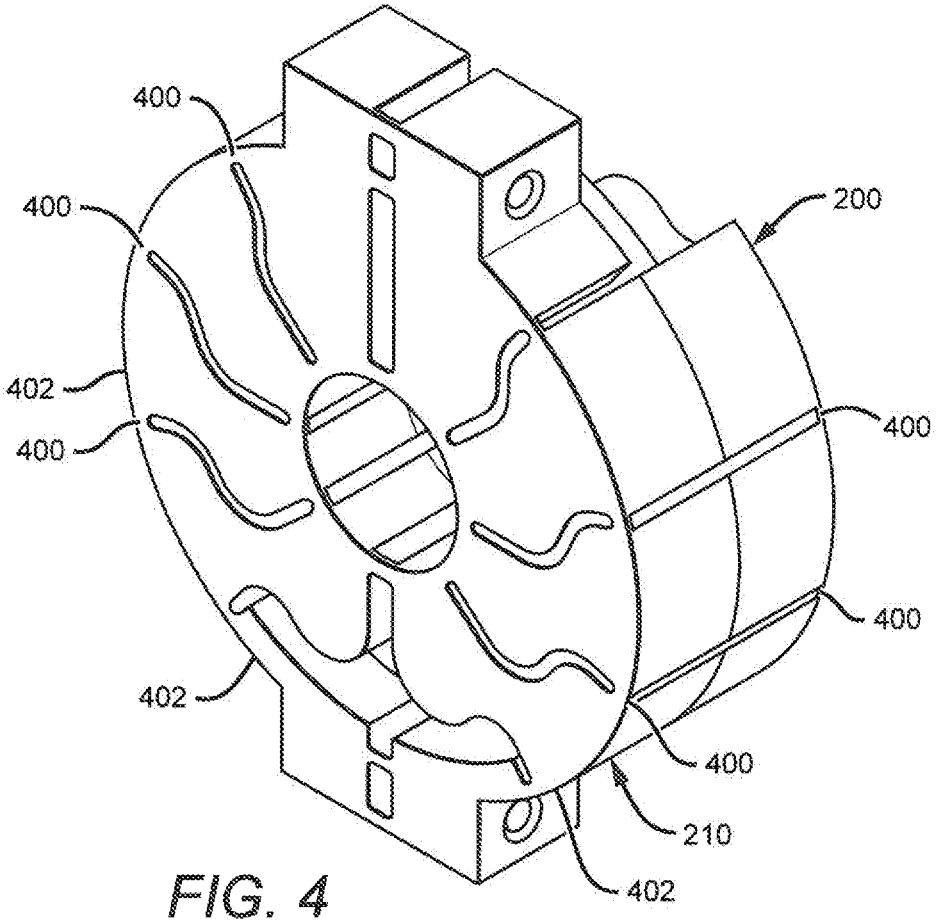
FIG. 4 is a bottom perspective view of a partially assembled common mode coil having tabs attaching adjacent coil fingers to facilitate assembly.

FIG. 4 is a bottom perspective view of a partially assembled common mode coil having tabs attaching adjacent coil fingers to facilitate assembly. In one embodiment, the upper and lower coil fingers are formed by machining, with small tabs remaining between fingers (Ref. 400, FIG. 4) to facilitate assembly together into a unitary structure (100, 110). Such tabs would then be removed after the upper and lower coil fingers are coupled cooperatively together. For example, in the embodiment where outer contact surfaces (225, 235, 245, 255, 270) and inner contact surfaces (230, 240, 250, 260) coupled together through a soldering process, the tabs may be removed subsequent to the soldering process. The flat lower surfaces 402 of each lower coil finger in the lower coil half 210 may receive a cold plate or other form of heat sink to provide effective removal of excess heat generated by the looping currents about the ferrite core.

Figure 5:
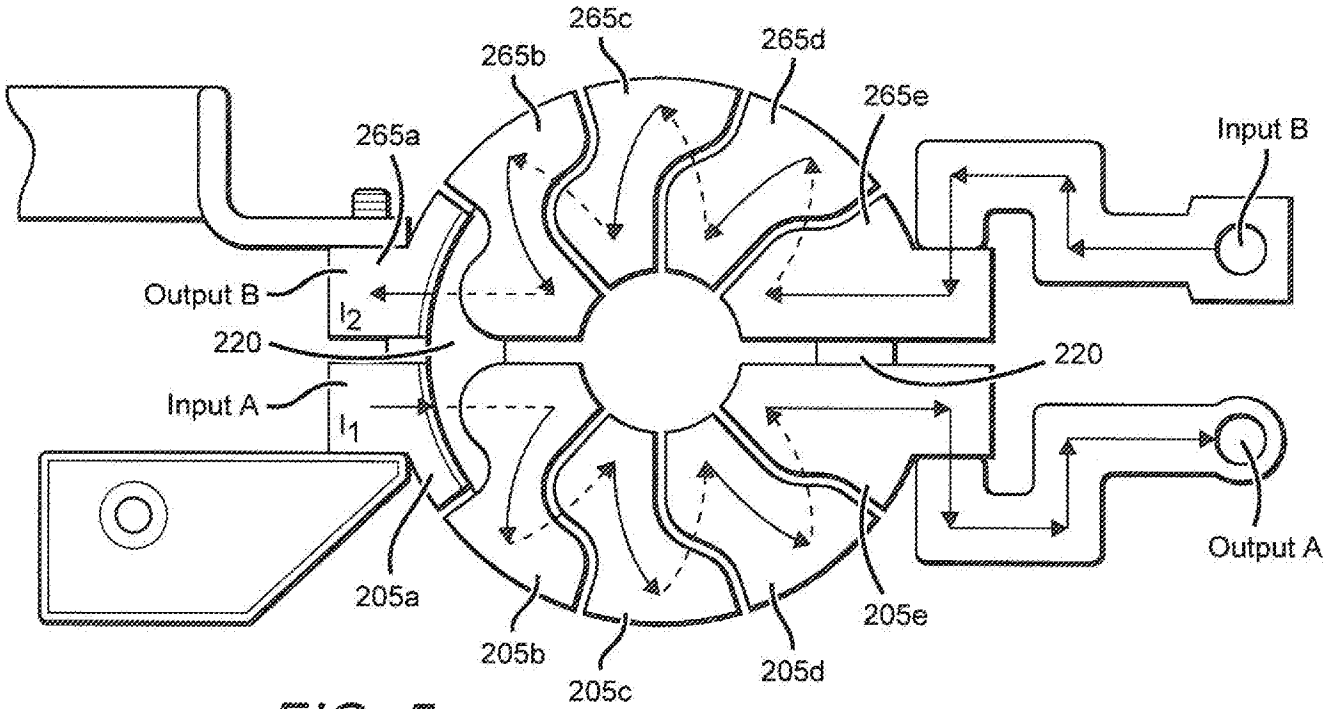
FIG. 5 is atop plan view having solid and dashed lines representing current flow through the common mode coil illustrated in FIGS. 2-4.

FIG. 5 depicts current flow in a first direction through the common mode choke illustrated in FIGS. 3-4. Current flow is indicated using solid and dashed arrowed lines, with solid lines indicating current flowing through visible components and dashed lines indicating current flowing through hidden components (with respect to the provided top plan view). Turning to a first a description of the looped current flow $I_1$, a voltage may be provided at Input A (alternatively referred to as Input Terminal A) and current $I_1$ may flow from coil finger 205*a* down under ferrite coil 220 and back up and over the ferrite coil 220 through upper coil finger 205*b* to form a first loop. Current $I_1$ proceeds down from upper coil finger 205*b* through lower coil finger 215*b* (see FIG. 2) and under ferrite coil 220 and back up and over the ferrite coil 220 through upper coil finger 205C to form a second loop. Current $I_1$ proceeds down and through lower coil 215*c* (see FIG. 2), under ferrite coil 220, and back up to upper coil finger 205*d* to form a third loop about the ferrite coil 220. Lastly, current $I_1$ may proceed down from upper coil finger 205*d*, through lower finger coil 215*d* (see FIG. 2) under ferrite coil 220, and back up again to upper coil finger 205*e* to form a fourth loop about the ferrite coil 220. The portion of the ferrite core 220 around which current $I_1$ proceeds may be referred to as a first segment of the ferrite core 220.

Current flow in a second direction through the common mode choke is indicated with current $I_2$. Such current $I_2$ is presented to Input B (alternatively referred to as Input Terminal B) which then proceeds serially in a looping manner through upper coil finger 265*e*, lower coil finger 270*d*, upper coil finger 265*c*, lower coil finger 270*b*, upper coil finger 265*b*, lower coil finger 270*a*, and finally to upper coil finger 265*a* for presentation to Output B (alternatively referred to as Output Terminal B. The portion of the ferrite core 220 around which current $I_2$ proceeds may be referred to as a second segment of the ferrite core 220.

With currents $I_1$ and $I_2$ flowing in opposite directions and looping around ferrite coil 220, such a configuration serves to cancel out or otherwise reduce unwanted electronic noise.

Figure 6:
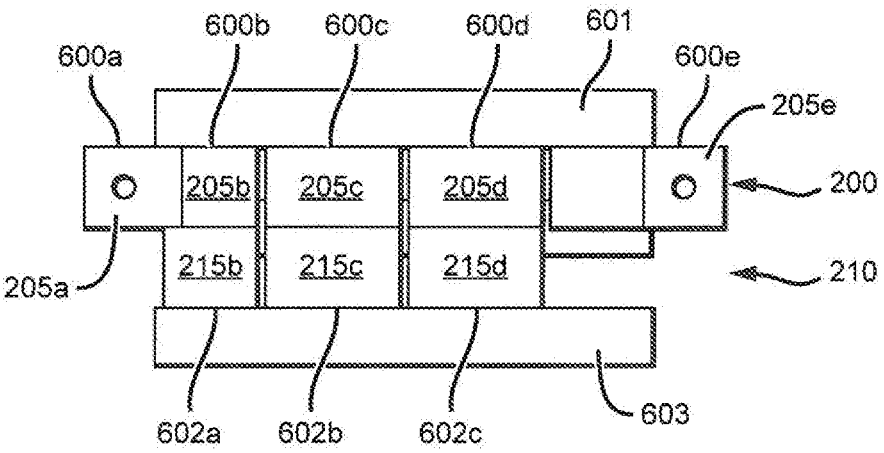
FIG. 6 is a side plan view of the common mode coil illustrated in FIGS. 2-4, and also having a top and bottom heat sinks thermally coupled to the flat upper and lower surfaces, respectively, of the first bus bar loop.

FIG. 6 is a side plan view of the illustrating a upper and lower heat sinks thermally coupled to the flat upper and lower surfaces, respectively, of the first bus bar loop. Each of the first plurality of upper coil fingers (205*a*, 205*b*, 205*c*, 205*d*, 205*e*) of the upper coil half 200 may have planar upper surfaces (600*a*, 600*b*, 600*c*, 600*c*), with the planar upper surfaces extending in a plane. The planar upper surfaces (600*a*, 600*b*, 600*c*, 600*c*) may be thermally coupled to an upper heat sink 601 to accept excess heat emitted by the upper coil fingers. Similarly, the lower coil half 210 may have a plurality of lower coil fingers (215*b*, 215*c*, 215*d*), each having respective planar lower surfaces (602*a*, 602*b*, 602*c*) with the planar lower surfaces extending in a plane and each thermally coupled to a lower heat sink 603.

What is claimed is:

1. A common mode choke apparatus, comprising:

a first bus bar made of an electrically and thermally conductive material, forming a first plurality of loops about a first segment of a toroidal ferrite core, the first bus bar having a plurality of first upper surfaces, wherein each of the plurality of first upper surfaces is disposed proximate to another of the plurality of first upper surfaces, and wherein each of the plurality of first upper surfaces has a serpentine shape from an inner region to an outer region of the common mode choke; and a second bus bar made of an electrically and thermally conductive material, forming a second plurality of loops about a second segment of the toroidal ferrite core, the second bus bar having a plurality of second upper surfaces, wherein the plurality of second upper surfaces is disposed proximate to another of the plurality of second upper surfaces, and wherein the plurality of second upper surfaces has a serpentine shape from the inner region to the outer region of the common mode choke;

wherein the serpentine shape of the plurality of the first upper surfaces and the serpentine shape of the plurality of second upper surfaces each has a smaller edge near the inner region and a larger edge near the outer region of the toroidal ferrite core; and wherein the first bus bar and the second bus bar assembled together, substantially encase the toroidal ferrite core.

2. The apparatus of claim 1, wherein each of first and second upper surfaces are planar.

3. The apparatus of claim 1, wherein each of the first and second upper surfaces extend in a plane.

4. The apparatus of claim 1, wherein each of the first and second upper surfaces are non-planar.

5. The apparatus of claim 1, further comprising:

a heat sink thermally coupled to the plurality of planar first and second surfaces.

6. The apparatus of claim 1, wherein each of the inner first upper surface portions are circumferentially offset from its respective outer first upper surface portions.

7. The apparatus of claim 1, wherein the toroidal ferrite core is a rectangular toroid.

8. A common mode choke apparatus, comprising:

a first conductive rigid winding about a ferrite core to form a first signal path; and a second conductive rigid winding about the ferrite core to form a second signal path;

wherein the first and second conductive rigid windings establish a planar upper surface, and wherein the first conductive rigid winding and the second conductive winding extends in a planar and serpentine manner about the planar upper surface of the common mode choke, and wherein the first conductive rigid winding and the second conductive rigid winding assembled together, substantially encases the ferrite core; and wherein the serpentine shape of the first conductive rigid winding and the serpentine shape of the second conductive rigid winding each has a smaller edge near an inner region and a larger edge near an outer region of the ferrite core.

9. The apparatus of claim 8, wherein the first conductive rigid winding extends in a planar and serpentine manner about a bottom surface of the common mode choke.

10. The apparatus of claim 9, wherein the ferrite core is seated in a bottom ferrite channel.

11. The apparatus of claim 8, wherein the first conductive rigid winding comprises a plurality of rigid plates.

12. The apparatus of claim 11, wherein each of the rigid plates extends in a serpentine manner from an inner radius of the common mode choke apparatus to an outer radius of the common mode choke apparatus.

13. The apparatus of claim 12, wherein an inner radius of each rigid plate is rotationally offset from an outer radius of each rigid plate.

14. The apparatus of claim 8, wherein the apparatus is configured to interface with a heat sink in thermal communication with the upper surface.

* * * * *